US009101525B2

(12) United States Patent
Maw

(10) Patent No.: US 9,101,525 B2
(45) Date of Patent: Aug. 11, 2015

(54) SELF BODY MASSAGER

(71) Applicant: David Scott Maw, Tappen, ND (US)

(72) Inventor: David Scott Maw, Tappen, ND (US)

( * ) Notice: Subject to any disclaimer, the term of this patent is extended or adjusted under 35 U.S.C. 154(b) by 189 days.

(21) Appl. No.: 13/782,107

(22) Filed: Mar. 1, 2013

(65) Prior Publication Data

US 2014/0249457 A1 Sep. 4, 2014

(51) Int. Cl.

| | |
|---|---|
| ***A61H 7/00*** | (2006.01) |
| ***A61H 19/00*** | (2006.01) |
| ***A61H 23/00*** | (2006.01) |
| ***A61H 15/00*** | (2006.01) |
| ***A61H 23/02*** | (2006.01) |

(52) U.S. Cl.

CPC .... *A61H 23/0263* (2013.01); *A61H 2015/0014* (2013.01); *A61H 2201/1284* (2013.01); *A61H 2201/1623* (2013.01); *A61H 2205/081* (2013.01)

(58) Field of Classification Search

CPC ..... A61H 15/00; A61H 2015/0071; A61H 2203/0443; A61H 2203/0456; A61H 2205/081

USPC ..... 482/51, 148, 142; 601/49, 115, 116, 601/134

See application file for complete search history.

(56) References Cited

U.S. PATENT DOCUMENTS

| | | | | | |
|---|---|---|---|---|---|
| 3,833,215 | A * | 9/1974 | Isdith | 482/51 |
| 4,191,371 | A * | 3/1980 | Armer, Jr. | 482/146 |
| 4,867,142 | A * | 9/1989 | Jones | 601/115 |
| 4,927,139 | A * | 5/1990 | Taltre | 482/142 |
| 5,125,880 | A * | 6/1992 | Peters | 482/68 |
| 6,017,297 | A * | 1/2000 | Collins | 482/146 |
| 6,063,015 | A * | 5/2000 | Johnston | 482/142 |
| 2003/0045409 | A1 * | 3/2003 | Herbst | 482/142 |
| 2003/0120188 | A1 * | 6/2003 | Kusumi | 601/115 |
| 2005/0242538 | A1 * | 11/2005 | Hiramatsu | 280/92 |
| 2006/0149174 | A1 * | 7/2006 | Fink | 601/121 |
| 2008/0269605 | A1 * | 10/2008 | Nakaya | 600/437 |
| 2011/0269605 | A1 * | 11/2011 | Kim et al. | 482/121 |
| 2012/0071306 | A1 * | 3/2012 | Bronston et al. | 482/139 |
| 2012/0190517 | A1 * | 7/2012 | Scott | 482/142 |
| 2013/0281892 | A1 * | 10/2013 | Godfrey et al. | 601/15 |

* cited by examiner

*Primary Examiner* — Kristen Matter

(74) *Attorney, Agent, or Firm* — MU Patents; Timothy Marc Shropshire

(57) ABSTRACT

Methods and apparatus are provided through which in some implementations an apparatus includes three notable features and attributes: a first curved bar, at least one additional curved bar and a roller. In some implementations, a pad or beams may be placed under the roller. The first curved bar is attached to at least one additional curved bar by a first attachment system, a second attachment system and at least one additional attachment system. Each attachment system consists of a fastener bolt, a fastener nut and at least one spacer. The first curved bar is laterally spaced from the at least one additional curved bar by the at least one spacer of the first, second and at least one additional attachment systems. The first curved bar and the at least one additional curved bar and the first, the second and the at least one additional attachment systems form a support assembly which is movably connected to the roller by a flexible connecting device.

20 Claims, 10 Drawing Sheets

SELF BODY MASSAGER

RELATED APPLICATIONS

There are no related applications for this application.

FIELD

The field of the invention relates generally to devices capable of being used by a person to massage his body by lying on the device and moving the device relative to the person.

BRIEF DESCRIPTION

A self-body massage apparatus is disclosed. In one aspect, the self-body massager comprises a first curved bar, at least one additional curved bar connected to the first curved bar, a roller located underneath the first curved bar and the least one additional curved bar, wherein the first curved bar and the at least one additional curved bar are connected by first, second and at least one additional attachment systems.

In another aspect, each of the first, second and at least one additional attachment systems comprise a fastener bolt and a fastener nut and at least one spacer located between the first curved bar and the at least one additional curved bar.

In a further aspect, the first curved bar, the at least one additional curved bar and the first, second and at least one additional attachment systems form a support system and the support system is movably connected to the roller by a flexible connecting device.

In an additional aspect, the self-body massage apparatus allows a user to lie on his back while being supported on the support system of the self-body massage apparatus. The self-body massage apparatus allows the user to shift his weight or push against a ground surface to allow the user and the support system of the self-body massage apparatus to move together relative to the roller of the self-body massage apparatus. This movement of the roller relative to the support system of the self-body massage apparatus is capable of allowing forces to be applied to various regions of a body of the user as would be experienced during a massage by a masseur. The forces to be applied to various regions of a body by the self-body massage apparatus may be used for physical problems including alleviating muscle discomfort, or for back alignment.

Self-body massage apparatuses of varying scope are described herein. In addition to the aspects and advantages described in this summary, further aspects and advantages will become apparent by reference to the drawings and by reading the detailed description that follows.

DETAILED DESCRIPTION

In the following detailed description, reference is made to the accompanying drawings that form a part hereof, and in which is shown by way of illustration specific implementations that may be practiced. These implementations are described in sufficient detail to enable those skilled in the art to practice the implementations, and it is to be understood that other implementations may be utilized and that logical, mechanical, electrical and other changes may be made without departing from the scope of the implementations. The following detailed description is, therefore, not to be taken in a limiting sense.

The detailed description is divided into three sections. In the first section, an apparatus is described. In the second section, a method is described. In the third section, a conclusion of the detailed description is provided.

Apparatus

Figure 1:
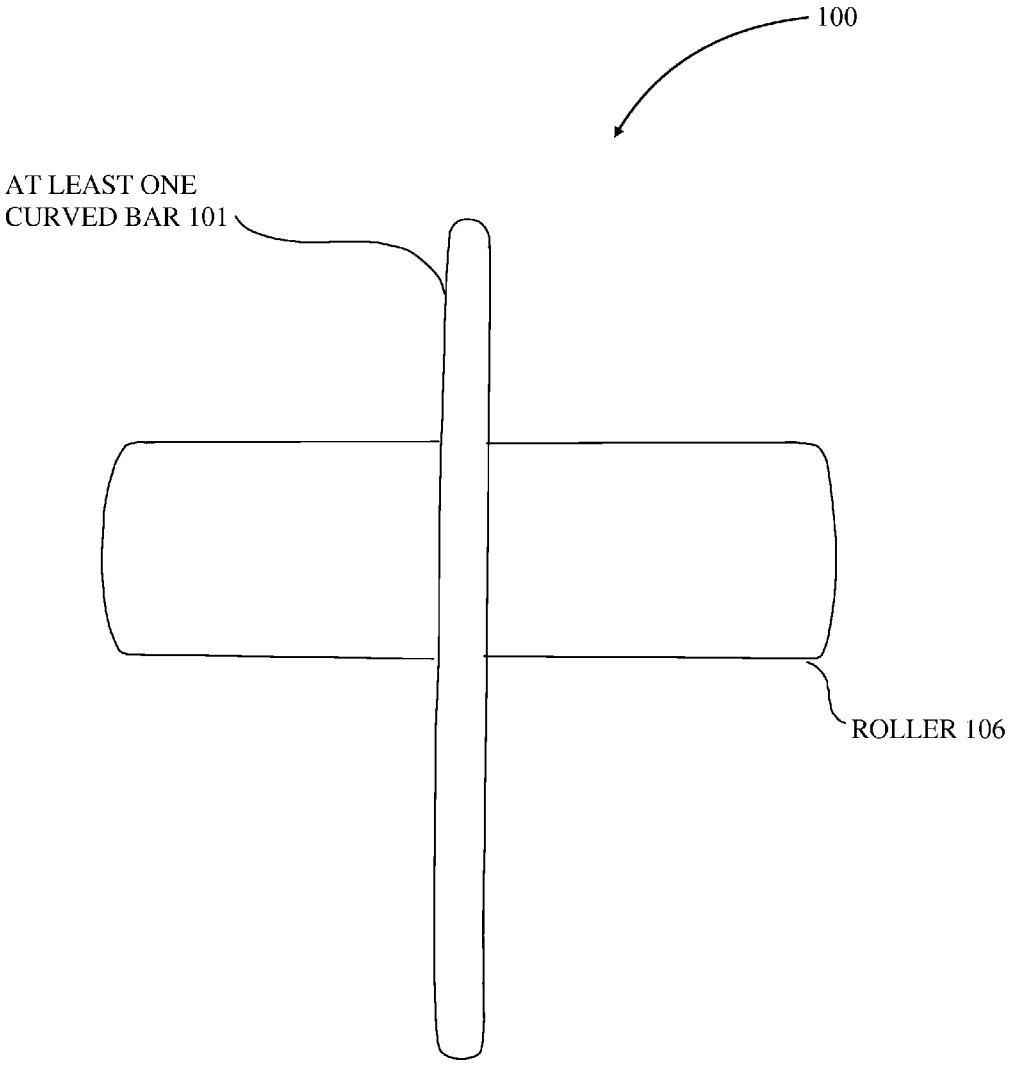
FIG. 1 is a perspective view of the self-body massage apparatus from above the self-body massage apparatus illustrating two notable features and attributes, according to an implementation.

FIG. 1 is a perspective view of the self-body massage apparatus 100 from above the self-body massage apparatus 100, according to an implementation. Apparatus 100 includes two notable features and attributes: at least one curved bar 101 extending in a longitudinal direction, and a roller 106 extending in a direction substantially perpendicular to the longitudinal direction.

Figure 2:
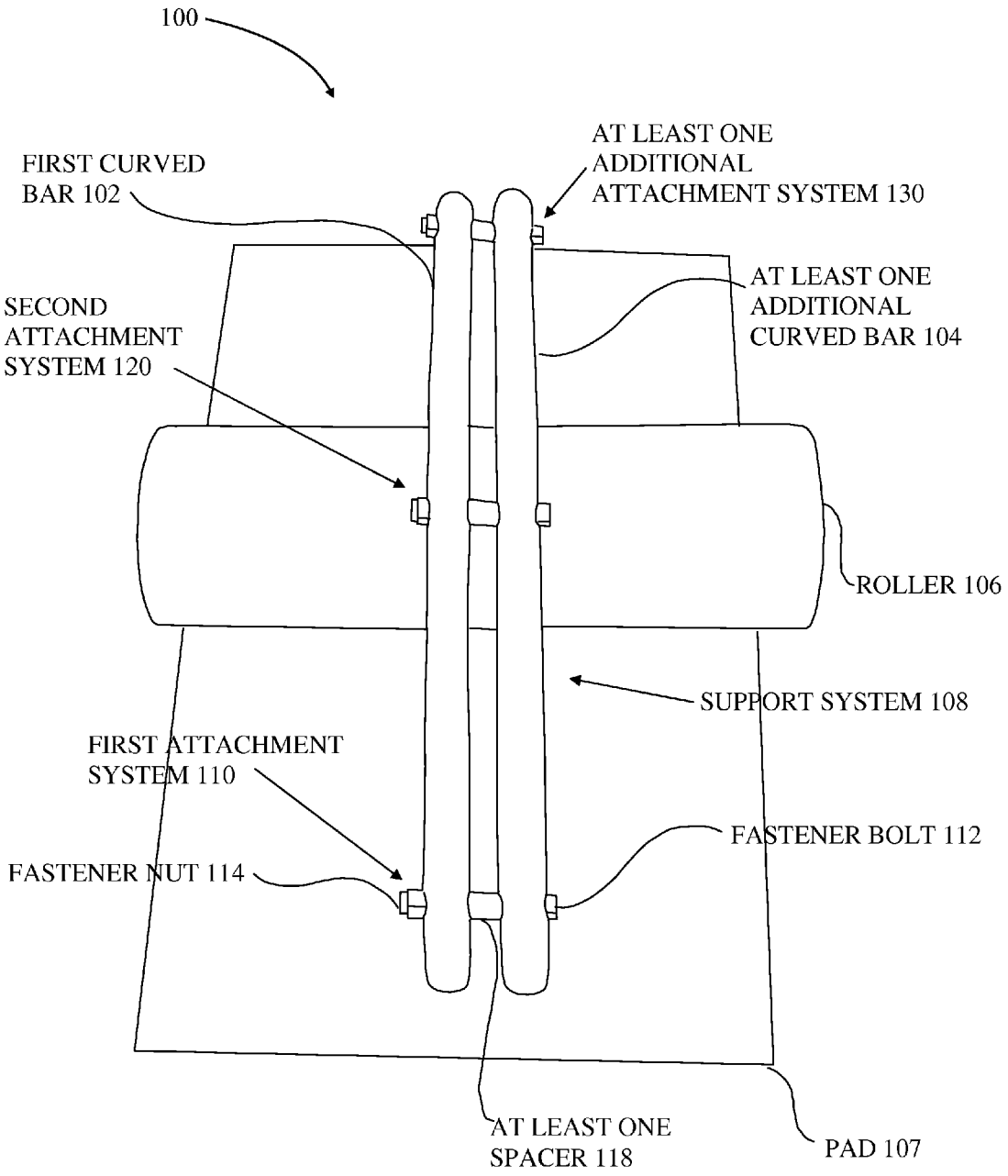
FIG. 2 is a perspective view of some implementations of the self-body massage apparatus from above the self-body massage apparatus, according to an implementation.

FIG. 2 is a perspective view of some implementations of the self-body massage apparatus from above the self-body massage apparatus, according to an implementation. In some implementations, the at least one curved bar 101 comprises a first curved bar 102 and at least one additional 104 curved bar. In some implementations the curved bars may or may not be parallel when viewed from above. In some implementations, the first curved bar 102 and the at least one additional curved bar 104 may be covered with foam, padding, or other cushioning material. In some implementations, a pad 107 may be placed under the roller 106. In some implementations, the pad 107 may be a rug or a towel, but is not limited to these objects. As illustrated on FIG. 2, the first curved bar 102 is attached to the at least one additional curved bar 104 by a first attachment system 110, a second attachment system 120 and at least one additional attachment system 130. Each of the first 110, second 120 and at least one additional 130 attachment systems consists of a fastener bolt 112, a fastener nut 114 and at least one spacer 116, the at least one spacer 116 is located between the first curved bar 102 and each of the at least one additional curved bar 104. In some implementations, the distance between the first curved bar 102 and the at least one additional curved bar 104 may be varied by installing different length spacers 116 between the first curved bar 102 and the at least one additional curved bar 104. The first curved bar 102 is laterally spaced from the at least one additional curved bar 104 by the at least one spacer 116 of the first 110, the second 120 and the at least one additional 130 attachment systems. The first 102 and at least one additional 104 curved bars and first 110, second 120 and at least one additional 130 attachment systems form a support assembly 108.

Figure 3:
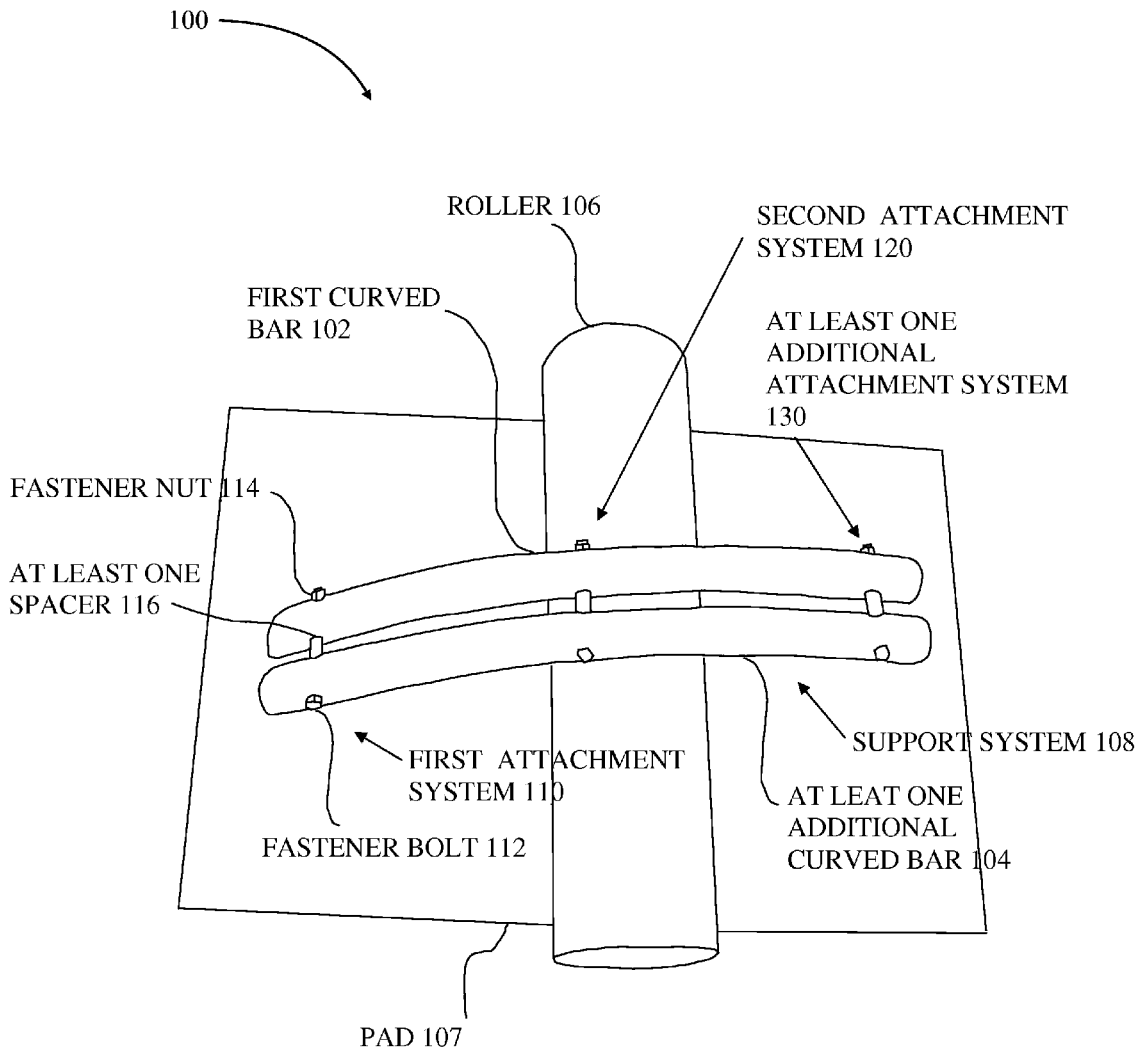
FIG. 3 is a perspective view of the self-body massage apparatus from a side of the self-body massage apparatus, according to an implementation.

FIG. 3 is a perspective view of the self-body massage apparatus 100 from a side of the self-body massage apparatus 100, according to an implementation.

Figure 4:
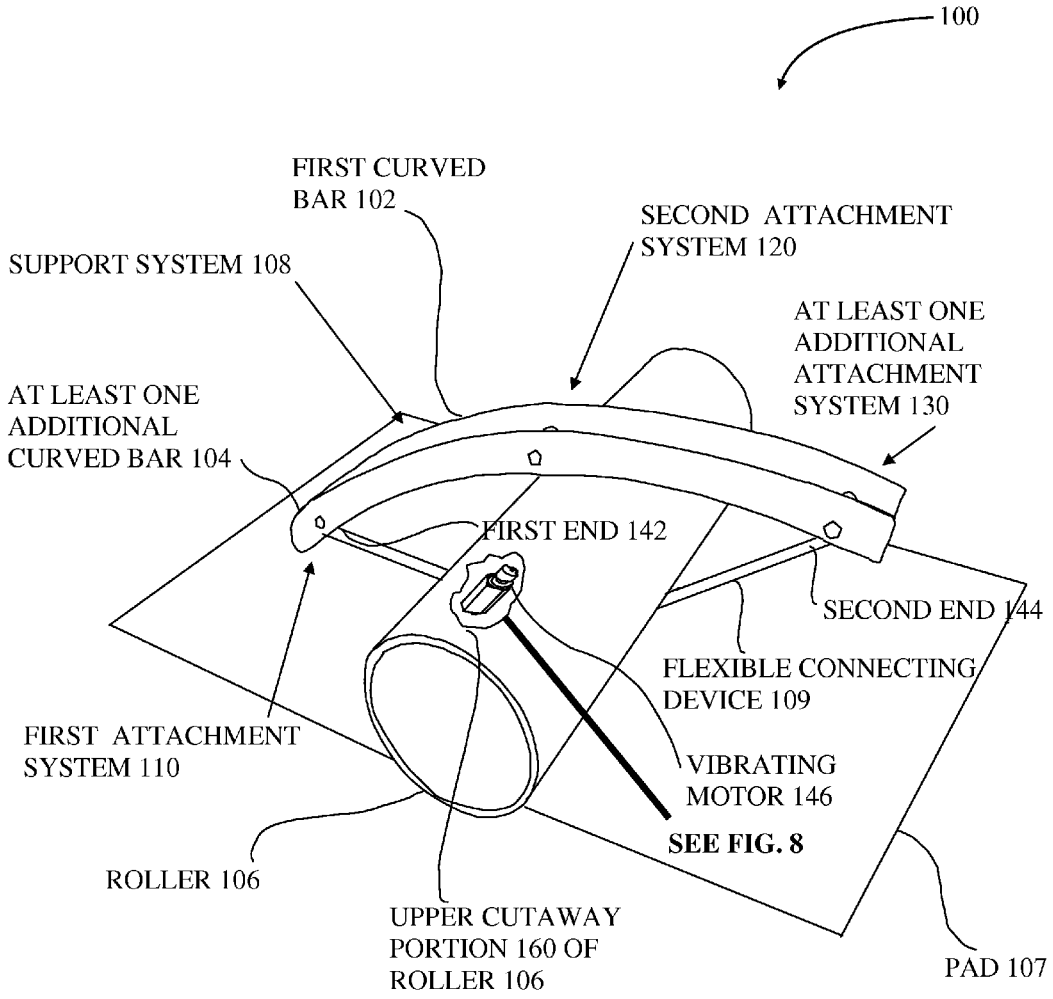
FIG. 4 is another perspective view of the self-body massage apparatus from a side of the self-body massage apparatus illustrating the flexible connecting device movably connecting the support assembly and the roller, according to an implementation.

FIG. 4 is another perspective view of the self-body massage apparatus 100 from a side of the self-body massage apparatus 100 illustrating the flexible connecting device 109 movably connecting the support assembly 108 and the roller 106, according to an implementation. As illustrated on FIG. 4, a flexible connecting device 109 is utilized to connect the support system 108 to the roller 106. In some implementations, the flexible connecting device 109 may be implemented by use rope, twine, or wire, but is not limited to these objects. As also illustrated on FIG. 4, a first end 142 of the flexible connecting device 109 is attached to the first attachment system 110 and a second end 144 of the flexible connecting device 109 is attached to the at least one additional attachment system 130. The connection of the support system 108 to the roller 106 by use of the flexible connecting device 109 allows the support system 108 to move relative to the roller 106 while the support system 108 maintains rolling contact with the roller 106. As illustrated on FIG. 4, in some implementations, a vibrating motor 146 may be attached to an inner surface of the roller 106 at an upper cutaway portion 160 of the roller 106.

Figure 5:
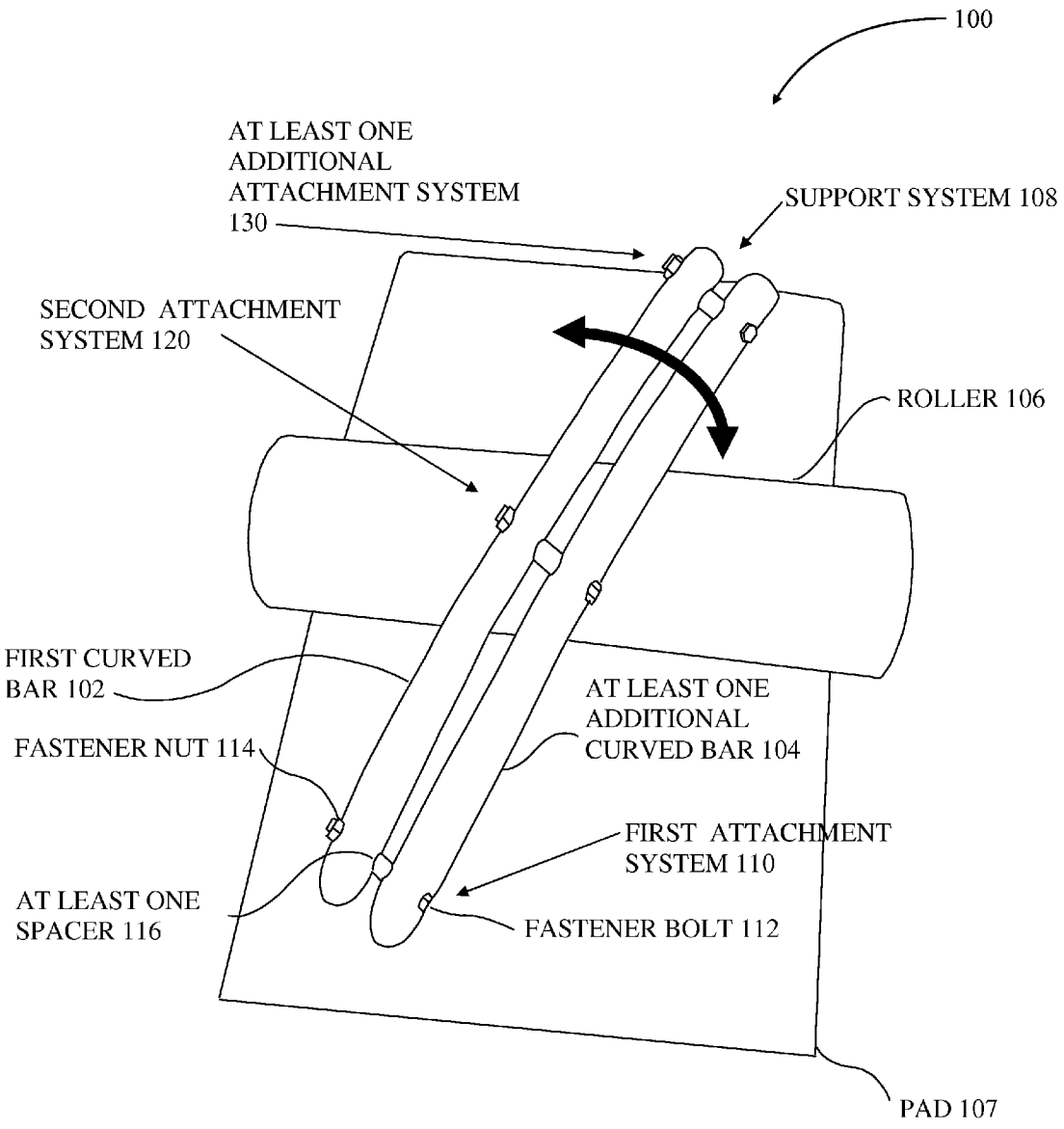
FIG. 5 is a perspective view of the self-body massage apparatus from above the self-body massage apparatus illustrating the curved bars inclined at an angle substantially non-perpendicular relative to the roller, according to an implementation.

FIG. 5 is a perspective view of the self-body massage apparatus 100 from above the self-body massage apparatus illustrating the first curved bar 102 and the at least one additional 104 curved bar inclined at an angle substantially non-perpendicular relative to the roller 106, according to an implementation. As illustrated on FIG. 5, the connection of the support system 108 to the roller 106 by use of the flexible connecting device 109 allows the support system 108 to move relative to the roller 106 in a rotational direction when viewed from above.

Figure 6:
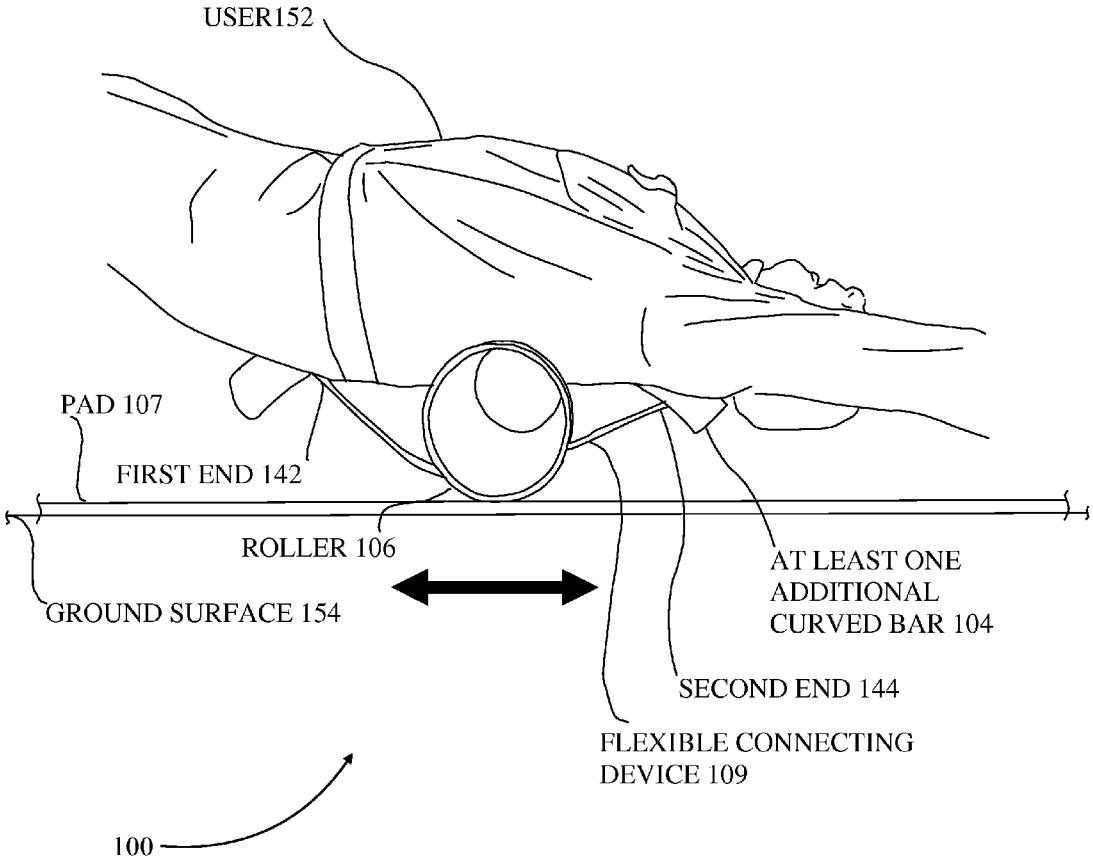
FIG. 6 is a perspective view of the self-body massage apparatus from a side of the self-body massage apparatus illustrating a user using the self-body massage apparatus, according to an implementation.

FIG. 6 is a perspective view of the self-body massage apparatus from a side of the self-body massage apparatus illustrating a user 152 using the self-body massage apparatus 100, according to an implementation. As illustrated on FIG. 6, the self-body massage apparatus 100 is supported by the pad 107, which in turn is supported by a ground surface 154. As further illustrated on FIG. 6, the first curved bar 102 and the at least one additional 104 curved bar of the support system 108 are capable of linear movement relative to the roller 106 when viewed from a side of the first curved bar 102.

Figure 7:
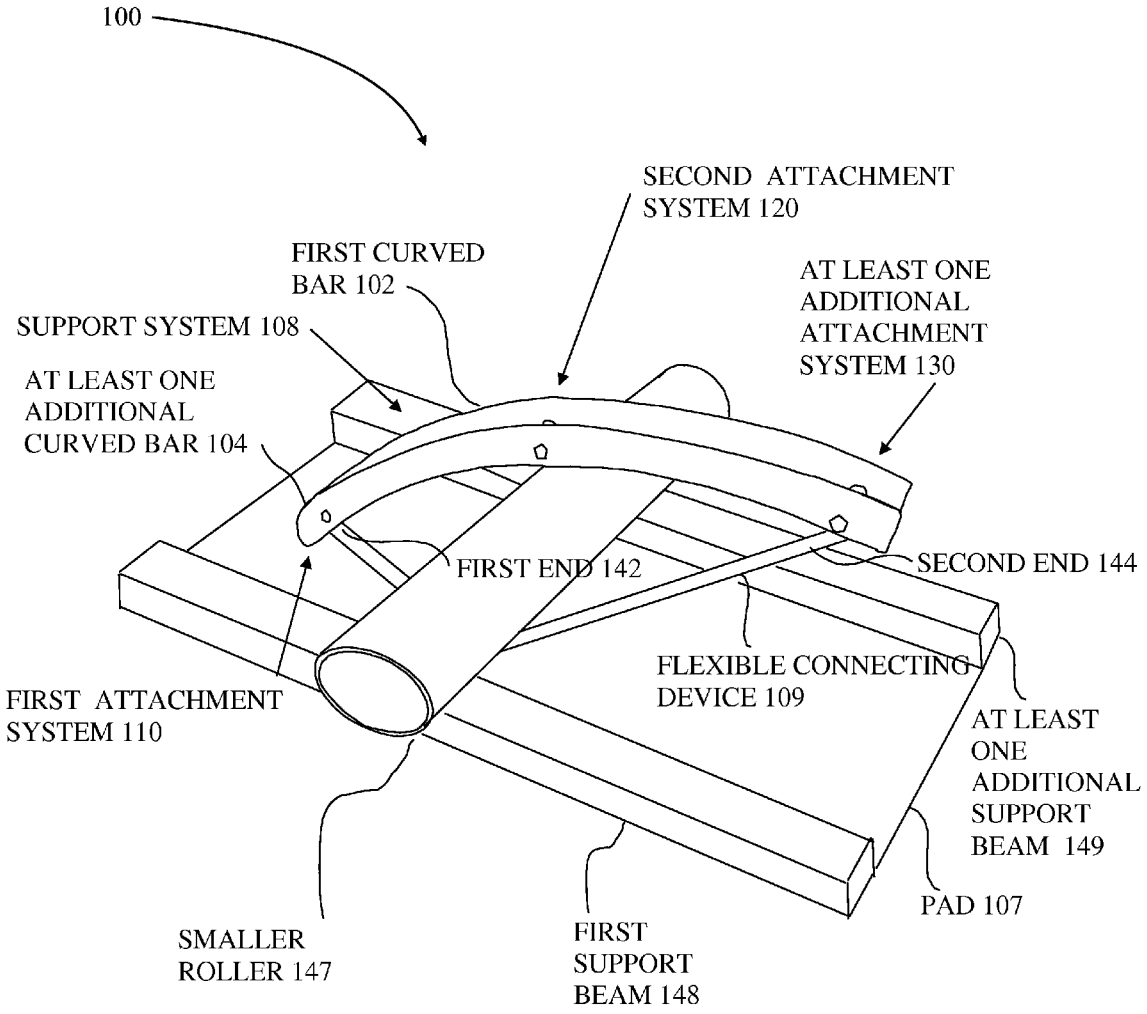
FIG. 7 is yet another perspective view of the self-body massage apparatus from a side of the self-body massage apparatus illustrating a means of support of the self-body massage apparatus 100, according to an implementation.

FIG. 7 is another perspective view of the self-body massage apparatus 100 from a side of the self-body massage apparatus 100 illustrating a means of support of the self-body massage apparatus 100, according to an implementation. As illustrated on FIG. 7, in some embodiments, the support assembly 108 is supported by a smaller roller 147. The smaller roller 147 is in turn supported by a first support beam 148 and at least one additional 149 support beam. In some embodiments, the first support beam 148 and at least one additional 149 support beam may be supported by the pad 107.

Figure 8:
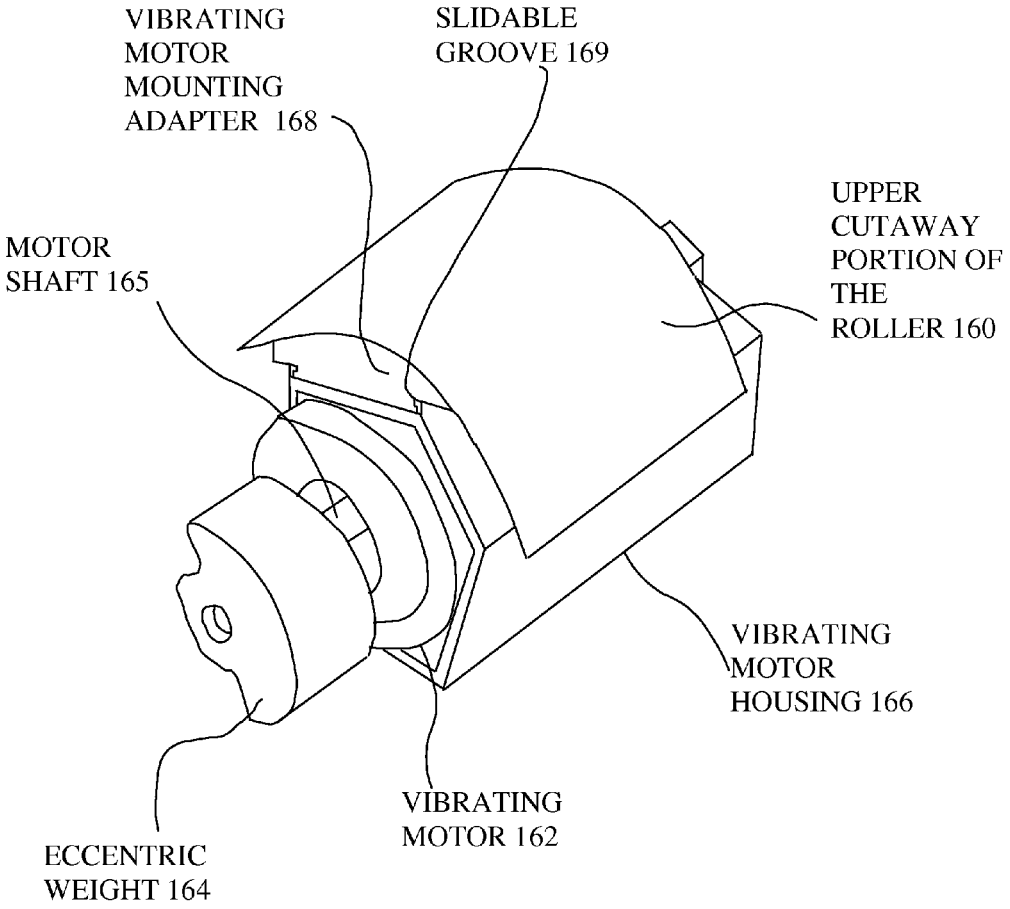
FIG. 8 is a detail perspective view of an upper cutaway portion of the roller illustrating a vibrator motor installed to the roller, according to an implementation.

FIG. 8 is a detail perspective view of an upper cutaway portion 160 of the roller 106 illustrating a vibrating motor 162 installed to the roller 106, according to an implementation. In some embodiments, the vibrating motor 162 may be powered by 120 volts AC electricity. In some other embodiments, the vibrating motor may be powered by batteries (not shown). An eccentric weight 164 on mounted on the motor shaft 165 causes the vibrating motor 162 to vibrate when the vibrating motor 162 is in operation. The vibrating motor 162 is installed into a vibrating motor housing 166. The vibrating motor housing 166 and vibrating motor 162 are then slidably installed to a vibrating motor mounting adapter 168 by use of slidable grooves 169 located on each side of the vibrating motor mounting adapter 168 and on each side of the vibrating motor housing 166. The vibrating motor adapter 168 is attached to the roller 106. In some embodiments, the vibrating motor adapter 168 is attached to the roller 106 by use of adhesives.

Figure 9:
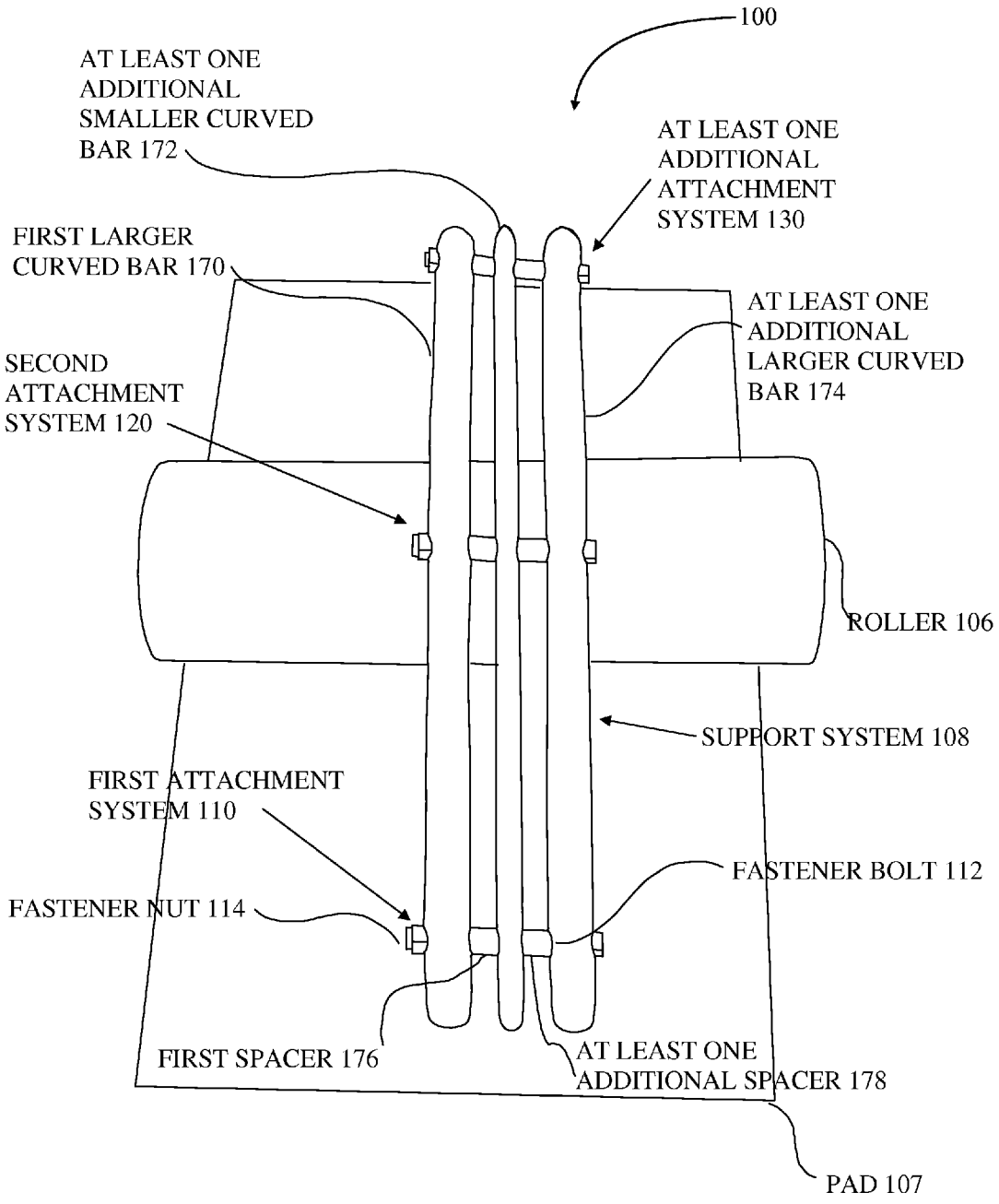
FIG. 9 is a perspective view of some implementations of the self-body massage apparatus from above the self-body massage apparatus illustrating a configuration of the self-body massage apparatus, according to an implementation.

FIG. 9 is a perspective view of some implementations of the self-body massage apparatus from above the self-body massage apparatus illustrating a configuration of the self-body massage apparatus, according to an implementation. In some implementations, the at least one additional 104 curved bar comprises a first larger curved bar 170 at least one additional smaller curved bar 172 and at least one additional larger curved bar 174. Other implementations may comprise other combinations of smaller and larger curved bars which may, or may not be parallel when viewed from above. As illustrated on FIG. 9, each of the at least one spacers 116 of the first 110, second 120 and at least one additional 130 attachment systems consists of a first spacer 176 and at least one additional spacer 178.

Method

Figure 10:
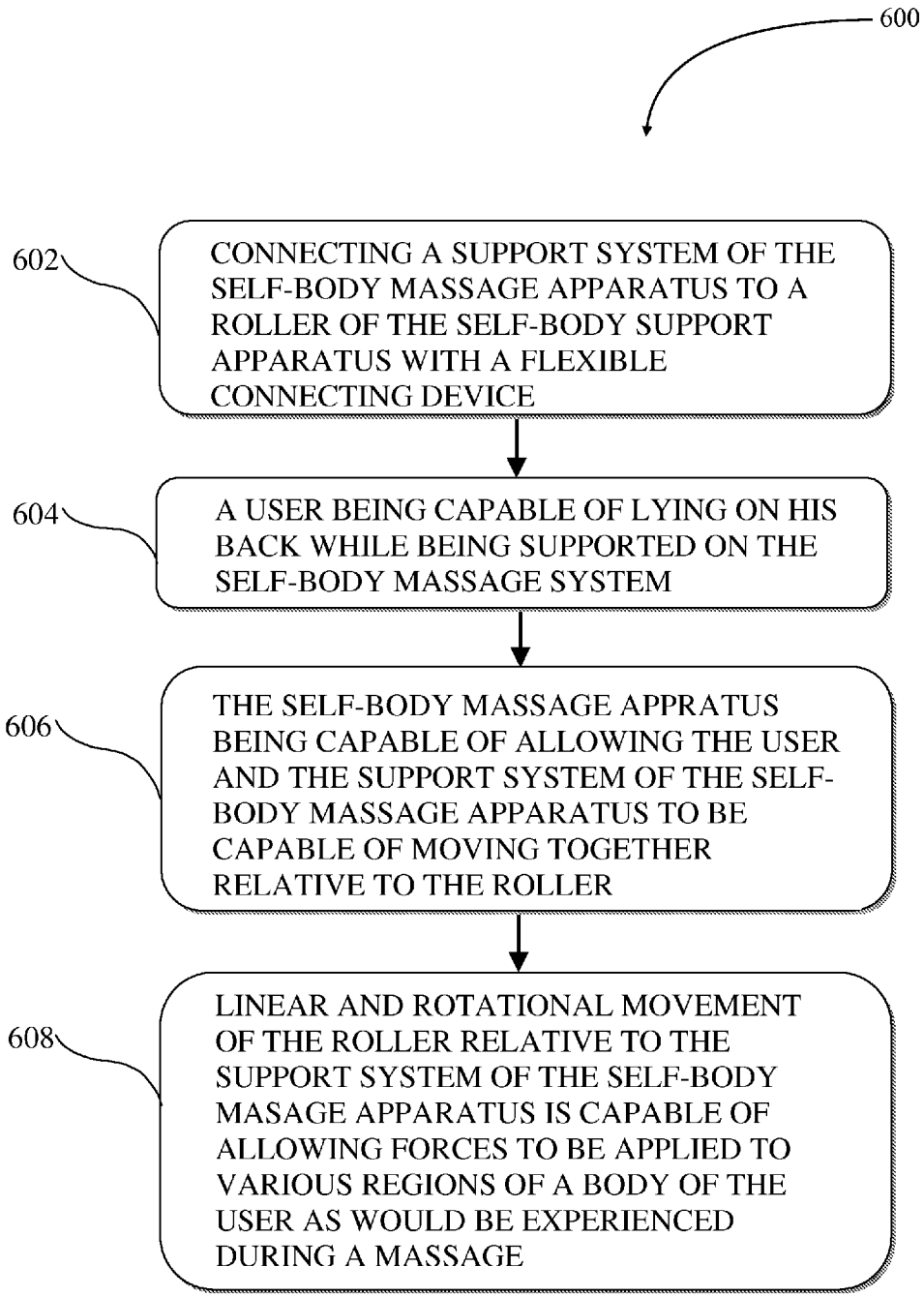
FIG. 10 is a flowchart of a method of using the self-body massage apparatus, according to an implementation.

FIG. 10 is a flowchart of a method 600 of using the self-body massage apparatus, according to an implementation. Method 600 includes connecting the support system 108 of the self-body massage apparatus 100 to the roller 106 of the self-body support apparatus 100 with the flexible connecting device 109 at block 602, positioning the self-body massage apparatus 100 to allow the user 152 to be capable of lying on his back while being supported on the self-body massage apparatus 100 at block 604, the self-body massage apparatus 100 being capable of allowing the user 152 to shift his weight and/or to push relative to the ground surface 154 with his hands, and/or or feet to allow the user 152 and the support system 108 of the self-body massage apparatus 100 to be capable of moving together relative to the roller 106 of the self-body massage apparatus 100 at block 606. Linear and rotational movement of the roller 106 of relative to the support system 108 of self-body massage apparatus 100 is capable of allowing forces to be applied to various regions of a body of the user 152 as would be capable of being experienced during a massage by a masseur at block 608. However, by use of the self-body massage apparatus 100, no masseur is required for the user 152 to receive the benefits of a massage by a masseur. The self-body massage apparatus may be used for physical problems including alleviating muscle discomfort, or for back alignment.

CONCLUSION

As a person skilled in the prior art will recognize after examination of the previous detailed description and the figures and claims, modifications and changes may be made to the preferred embodiments of the invention without departing from the scope of the invention as defined in the following claims.

I claim:

1. A self-body massage apparatus for applying forces to various regions of a human body, comprising:

a. a first curved bar and at least one additional curved bar located on a side of the first curved bar extending in a longitudinal direction, wherein the first curved bar and the at least one additional curved bar appear curved when viewed from the side of the first curved bar;

b. a roller located underneath the first curved bar and the at least one additional curved bar, the roller extending in a direction substantially perpendicular to the longitudinal direction;

c. a first attachment system, a second attachment system, and at least one additional attachment system, wherein the first attachment system, the second attachment system, and the at least one additional attachment system each consists of a fastener bolt, a fastener nut, and at least one spacer located between the first curved bar and the at least one additional curved bar, wherein the at least one spacer may be removed and replaced by a different size spacer in order to vary a distance between the first curved bar and the at least one additional curved bar; and d. a flexible connecting device, wherein the first curved bar and the at least one additional curved bar are connected by the first attachment system, the second attachment system, and the at least one additional attachment system, and wherein the first curved bar, the at least one additional curved bar, and the first attachment system, the second attachment system, and the at least one additional attachment system form a support system, wherein the support system is movably connected to the roller by the flexible connecting device, and wherein a first end of the flexible connecting device is attached to the first attachment system between the first curved bar and the at least one additional curved bar, and a second end of the flexible connecting device is connected to the at least one additional attachment system between the first curved bar and the at least one additional curved bar.

2. The self-body massage apparatus of claim 1, further comprising a vibrating motor attached to the roller.

3. The self-body massage apparatus of claim 2, further comprising:

a. a vibrating motor housing; and b. a vibrating motor mounting adapter, wherein the vibrating motor is attached to the roller using the vibrating motor housing and the vibrating motor mounting adapter.

4. The self-body massage apparatus of claim 1, wherein the first curved bar and the at least one additional curved bar are parallel when viewed from above.

5. The self-body massage apparatus of claim 1, further comprising a first support beam and at least one additional support beam, wherein the roller is directly supported by the first support beam and the at least one additional support beam.

6. The self-body massage apparatus of claim 1, wherein the support system is capable of linear movement relative to the roller when viewed from above and from the side and wherein the support system is capable of rotational movement relative to the roller when viewed from above.

7. A self-body massage apparatus for applying forces to various regions of a human body, comprising:

a. a first curved bar and at least one additional curved bar located on a side of the first curved bar extending in a longitudinal direction, wherein the first curved bar and the at least one additional curved bar appear curved when viewed from the side of the first curved bar;

b. a roller located underneath the first curved bar and the at least one additional curved bar, the roller extending in a direction substantially perpendicular to the longitudinal direction; and c. a first attachment system, a second attachment system, and at least one additional attachment system, wherein the first attachment system, the second attachment system, and the at least one additional attachment system each consists of a fastener bolt, a fastener nut and at least one spacer located between the first curved bar and the at least one additional curved bar, wherein the at least one spacer may be removed and replaced by a different size spacer in order to vary a distance between the first curved bar and the at least one additional curved bar, wherein the first curved bar and the at least one additional curved bar are connected by the first attachment system, the second attachment system, and the at least one additional attachment system, and wherein the first curved bar, the at least one additional curved bar and the first attachment system, the second attachment system, and the at least one additional attachment system form a support system, wherein the support system is capable of linear movement relative to the roller when viewed from above and from the side, and wherein the support system is capable of rotational movement relative to the roller when viewed from above.

8. The self-body massage apparatus of claim 7, further comprising a vibrating motor attached to the roller.

9. The self-body massage apparatus of claim 8, further comprising:

a. a vibrating motor housing; and b. a vibrating motor mounting adapter, wherein the vibrating motor is attached to the roller using the vibrating motor housing and the vibrating motor mounting adapter.

10. The self-body massage apparatus of claim 7, wherein the first curved bar and the at least one additional curved bar are parallel when viewed from above.

11. The self-body massage apparatus of claim 7, further comprising a first support beam and at least one additional support beam, wherein the roller is directly supported by the first support beam and the at least one additional support beam.

12. The self-body massage apparatus of claim 7, further comprising a flexible connecting device, wherein the first curved bar, the at least one additional curved bar and the first attachment system, the second attachment system, and the at least one additional attachment system form a support system that is movably connected to the roller by the flexible connecting device.

13. A self-body massage apparatus for applying forces to various regions of a human body, comprising:

a. a first curved bar and at least one additional curved bar located on a side of the first curved bar, wherein the first curved bar and the at least one additional curved bar extend in a longitudinal direction and appear curved when viewed from the side of the first curved bar;

b. a roller located underneath the first curved bar and the at least one additional curved bar, the roller extending in a direction substantially perpendicular to the longitudinal direction, wherein the roller is configured to engage with the first curved bar and the at least one additional curved bar, and wherein the roller, the first curved bar and the at least one additional curved bar are capable of rotational and linear movement relative to one another when engaged, and wherein the curvature of the first bar and the at least one additional curved bar is configured to engage with a user's body; and c. at least two attachment systems, wherein the first curved bar and the at least one additional curved bar are connected by the at least two attachment systems, and wherein each of the at least two attachment systems consists of a fastener bolt, a fastener nut and at least one spacer located between the first curved bar and the at least one additional curved bar, wherein the at least one spacer is configured to be removed and replaced by a different size spacer in order to vary a distance between the first curved bar and the at least one additional curved bar.

14. The self-body massage apparatus of claim 13, wherein the first curved bar and the at least one additional curved bar are parallel when viewed from above.

15. The self-body massage apparatus of claim 13, further comprising a first support beam and at least one additional support beam, wherein the roller is directly supported by the first support beam and the at least one additional support beam.

16. The self-body massage apparatus of claim 13, further comprising a flexible connecting device, wherein the first curved bar, the at least one additional curved bar and the at least two attachment systems form a support system that is movably connected to the roller by the flexible connecting device.

17. The self-body massage apparatus of claim 16, wherein a first end of the flexible connecting device is attached to a first attachment system of the at least two attachment systems between the first and the at least one additional curved bar, and a second end of the flexible connecting device is connected to a second attachment system of the at least two attachment systems between the first curved bar and the at least one additional curved bar.

18. The self-body massage apparatus of claim 16, wherein the support system is capable of linear movement relative to the roller when viewed from above and from the side and wherein the support system is capable of rotational movement relative to the roller when viewed from above.

19. The self-body massage apparatus of claim 13, further comprising a vibrating motor attached to the roller.

20. The self-body massage apparatus of claim 19, further comprising:

a. a vibrating motor housing; and b. a vibrating motor mounting adapter, wherein the vibrating motor is attached to the roller using the vibrating motor housing and the vibrating motor mounting adapter.

* * * * *